US011306378B2

(12) United States Patent
Antonsson et al.

(10) Patent No.: US 11,306,378 B2
(45) Date of Patent: Apr. 19, 2022

(54) DUPLEX STAINLESS STEEL

(71) Applicant: Sandvik Intellectual Property AB, Sandviken (SE)

(72) Inventors: Tomas Antonsson, Sandviken (SE); Lars Nylöf, Gävle (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 16/969,711

(22) PCT Filed: Feb. 14, 2019

(86) PCT No.: PCT/EP2019/053735

§ 371 (c)(1),
(2) Date: Aug. 13, 2020

(87) PCT Pub. No.: WO2019/158663

PCT Pub. Date: Aug. 22, 2019

(65) Prior Publication Data

US 2021/0002750 A1 Jan. 7, 2021

(30) Foreign Application Priority Data

Feb. 15, 2018 (EP) ..... 18157043

(51) Int. Cl.

| | |
|---|---|
| ***C22C 38/58*** | (2006.01) |
| ***C21D 8/02*** | (2006.01) |
| ***C21D 8/06*** | (2006.01) |
| ***C21D 8/10*** | (2006.01) |
| ***C21D 9/08*** | (2006.01) |
| ***C21D 9/46*** | (2006.01) |
| ***C21D 9/52*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |

(52) U.S. Cl.

CPC ..... *C22C 38/58* (2013.01); *C21D 8/0205* (2013.01); *C21D 8/0226* (2013.01); *C21D 8/0236* (2013.01); *C21D 8/065* (2013.01); *C21D 8/105* (2013.01); *C21D 9/08* (2013.01); *C21D 9/46* (2013.01); *C21D 9/525* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C21D 2211/001* (2013.01); *C21D 2211/005* (2013.01)

(58) Field of Classification Search

CPC ..... C21D 6/02; C21D 8/065; C21D 8/105; C21D 6/005; C22C 38/00; C22C 38/004; C22C 38/42

USPC ..... 420/49

See application file for complete search history.

(56) References Cited

U.S. PATENT DOCUMENTS

| | | | |
|---|---|---|---|
| 2005/0158201 | A1 | 7/2005 | Park et al. |
| 2015/0152530 | A1 | 6/2015 | Sagara et al. |

FOREIGN PATENT DOCUMENTS

| | | | |
|---|---|---|---|
| CN | 1125965 | A | 7/1996 |
| CN | 1643176 | A | 7/2005 |
| CN | 103975088 | A | 8/2014 |
| CN | 104411850 | A | 3/2015 |
| JP | 2003-147489 | A | 5/2003 |
| JP | 2006-183129 | A | 7/2006 |
| KR | 2015-0074691 | A | 7/2015 |
| KR | 10-1614623 | B1 | 4/2016 |
| WO | 95/00674 | A1 | 1/1995 |
| WO | 00/28101 | A1 | 5/2000 |
| WO | 90/79017 | A1 | 12/2000 |
| WO | 01/00898 | A1 | 1/2001 |
| WO | 01/64969 | A1 | 9/2001 |
| WO | 2006/049572 | A1 | 5/2006 |
| WO | 2013/064746 | A1 | 5/2013 |

OTHER PUBLICATIONS

NPL: on-line translation of CN 1643176 A, Jul. 2005 (Year: 2005).*

Notification of First Office Action dated Jul. 2, 2021 in Chinese Application No. 201980013554.6.

Zhang Jinzhu et al., "Thin Slab Continuous Casting Device and Production Technology", Beijing: Metallurgical Industry Press, Aug. 2007, p. 169.

Cui Fengping et al., "Medium and Heavy Plate Production and Quality Control", Beijing: Metallurgical Industry Press, Oct. 2008, p. 359.

International Search Report and Written Opinion dated Mar. 7, 2019, issued in corresponding International Patent Application No. PCT/EP2019/053735.

* cited by examiner

*Primary Examiner* — Jie Yang

(74) *Attorney, Agent, or Firm* — Morgan, Lewis & Bockius LLP

(57) ABSTRACT

The present disclosure relates to a duplex stainless steel comprising in weight % (wt %): C less than 0.03; Si less than 0.60; Mn 0.40 to 2.00; P less than 0.04; S less than or equal to 0.01; Cr more than 30.00 to 33.00; Ni 6.00 to 10.00; Mo 1.30 to 2.90; N 0.15 to 0.28; Cu 0.60 to 2.20; Al less than 0.05; balance Fe and unavoidable impurities. The present disclosure also relates to a component or a construction material comprising the duplex stainless steel. Additionally, the present disclosure also relates to a process for manufacturing a component comprising said duplex stainless steel.

26 Claims, No Drawings

DUPLEX STAINLESS STEEL

TECHNICAL FIELD

The present disclosure relates to a duplex stainless steel which is suitable for applications wherein the material is exposed to high stresses in a corrosive environment. Furthermore, the present disclosure also relates to the use of the duplex stainless steel and to products manufactured thereof, especially suitable for use in offshore applications.

BACKGROUND

In many applications, high mechanical properties in combination with good corrosion resistance is crucial for design and construction of structural parts and components. Parts and components subjected to a corrosive environment, are also often loaded to high stresses, especially in seawater applications. Super duplex and hyper duplex stainless steels offer an established solution to this problem, particularly for components of smaller dimensions, as these steels have high strength. However, super duplex and especially hyper duplex stainless steels are sensitive to precipitation of intermetallic phases in their microstructure. This will deteriorate both the corrosion properties and the mechanical properties of the parts and components, such as the impact toughness. Intermetallic phases will usually form when components with large dimensions, such as rods, bars, hollows, plates as well as thick-walled tubes, are manufactured or welded c, because of the lower cooling rate for the heavier or thicker sections.

Hence, there is a need for a construction material for structural parts and components which will provide a combination of as high mechanical properties, such as high strength and impact toughness, and as good corrosion resistance as possible. Such construction material should also have sufficient structural stability, meaning that it should provide for the possibility for manufacturing components with large dimensions as well as welding of these components, without or essentially without formation of detrimental intermetallic phases. The aim of the present disclosure is to provide a new duplex stainless steel which will fulfill these requirements.

SUMMARY

The present disclosure therefore provides a duplex stainless steel comprising in weight % (wt %):

| | |
|---|---|
| C | less than 0.03; |
| Si | less than 0.60; |
| Mn | 0.40 to 2.00; |
| P | less than 0.04; |
| S | less than or equal to 0.01; |
| Cr | more than 30.00 to 33.00; |
| Ni | 6.00 to 10.00; |
| Mo | 1.30 to 2.90; |
| N | 0.15 to 0.28; |
| Cu | 0.60 to 2.20; |
| Al | less than 0.05; |
| balance Fe and unavoidable impurities. | |

This inventive steel has a very high yield strength in combination with a good corrosion resistance as well as an improved structural stability relative to the hyper duplex stainless steels available today. Thus, the present duplex stainless steel will advantageously be used in parts having large dimensions which are exposed to high stresses and corrosive environments, such as seawater or similar environments. Furthermore, the present duplex stainless steel comprises relatively low amounts of expensive alloying elements, such as Mo, and therefore the present duplex stainless steel will be available at a lower cost.

DETAILED DESCRIPTION

The present disclosure relates to a duplex stainless steel comprising in weight % (wt %):

| | |
|---|---|
| C | less than 0.03; |
| Si | less than 0.60; |
| Mn | 0.40 to 2.00; |
| P | less than 0.04; |
| S | less than or equal to 0.01; |
| Cr | more than 30.00 to 33.00; |
| Ni | 6.00 to 10.00; |
| Mo | 1.30 to 2.90; |
| N | 0.15 to 0.28; |
| Cu | 0.60 to 2.20; |
| Al | less than 0.05; |
| balance Fe and unavoidable impurities. | |

As mentioned above, this duplex stainless steel has a unique combination of high mechanical properties and good corrosion properties, such as very high yield strength and high impact toughness, as well as resistance against pitting corrosion. Furthermore, the present duplex stainless steel will, when used in components having large dimensions, such as for example but not limited to, a component having a diameter of up to about 250 mm, such as a diameter up to about 50 mm, e.g. 150×50 mm, form low amounts of intermetallic phases during solution heat treatment and subsequent cooling. The slow precipitation of intermetallic phases during solution heat treatment and subsequent cooling means that the present duplex stainless steel will have a stable microstructure. Hence, the low amounts of detrimental intermetallic phases formed will essentially not have an impact on the final microstructure and the final properties of the manufactured component. One example of a detrimental intermetallic phase is sigma phase.

In the present disclosure, a duplex stainless steel is a steel which has a ferrite content of from 40 to 70 vol % and the balance is austenite.

The various alloying elements and their effects on the properties of the duplex stainless steel according to the present disclosure are described below. The description on the effects should not be considered as limited, the elements may also provide other effects not mentioned herein. The terms "weight %", "wt %" and "%" are used interchangeably:

Carbon (C): Less than 0.03 wt %

C is a strong austenite phase stabilizing alloying element. However, an excess of C will increase the risk of sensitization during welding or manufacturing due to the formation of chromium carbides, which in turn will reduce the corrosion resistance. Thus, the C content of the present duplex stainless steel is set to be less than 0.03 wt %.

Silicon (Si): Less than 0.60 wt %

Si is a strong ferrite phase stabilizing alloying element and its content will therefore have to be tuned with respect to the amounts of other ferrite forming elements, such as Cr and Mo, in order to achieve the desired duplex structure. If Si is added in an excessive amount, the formation of ferrite phase will be too high as well as the formation of intermetallic precipitates, such as the detrimental sigma phase. This will, in turn, deteriorate both the corrosion properties and the mechanical properties. Accordingly, the Si content is set to be less than 0.60 wt %, such as less than 0.30 wt %.

Manganese (Mn): 0.40 to 2.00 wt %

Mn is an austenite phase stabilizing alloying element, which will also promote the solubility of Nitrogen (N) in the austenite phase at high temperatures and will thereby increase the deformation hardening. Mn will further reduce the detrimental effect of sulphur (S) by forming MnS precipitates, which in turn will enhance the hot ductility and the toughness of the present duplex stainless steel. In order to achieve these positive effects, the lowest Mn content has to be 0.40 wt %. Additionally, if the Mn content is excessive, the amount of austenite may become too large and various mechanical properties, such as hardness and corrosion resistance, may be reduced. Also, a too high content of Mn will reduce the hot working properties and impair the surface quality. Hence, the highest amount of Mn that can be present is 2.00 wt %. Thus, the content of Mn is of from 0.40 to 2.00 wt %. According to one embodiment, the content of Mn is 0.60 to 1.80 wt %.

Chromium (Cr): More than 30.00 to 33.00 wt %

Cr is one of the main alloying elements of a stainless steel as this element will provide the necessary corrosion resistance and strength. The duplex stainless steel as defined hereinabove or hereinafter comprises, in order to achieve the desired corrosion resistance and strength, of more than 30.00 wt % Cr. Furthermore, Cr is a strong ferrite phase stabilizing alloying element and must therefore be balanced against other ferrite and austenite forming elements present in the steel in order to achieve the desirable amounts of ferrite and austenite phases. Additionally, if Cr is present in an excessive amount, it will affect the toughness which will be reduced due to the formation of chromium nitrides and due to the promotion of the detrimental sigma phase. Hence, the content of Cr is of from more than 30.00 to 33.00 wt %. According to one embodiment, the content of Cr is 30.50 to 32.50 wt %.

Molybdenum (Mo): 1.30 to 2.90 wt %

Mo is a strong ferrite phase stabilizing alloying element and promotes the formation of the ferrite phase. Furthermore, Mo contributes strongly to the pitting corrosion resistance and improves the mechanical properties, especially the yield strength. In order to achieve these effects in the present duplex stainless steel, the lowest content of Mo is 1.30 wt %. However, Mo is an expensive element which strongly promotes formation of the detrimental sigma phase. Hence, the present duplex stainless steel therefore comprises less than or equal to 2.90 wt % Mo. In order to obtain better properties, according to embodiment, the content of Mo is 1.35 to 2.90 wt %, such as 1.40 to 2.80 wt %, such as 1.50 to 2.75 wt %, such as 1.50-2.50 wt %.

Nickel (Ni): 6.00 to 10.00 wt %

Ni is an austenite phase stabilizing alloying element. It has been found that Ni will provide the present duplex stainless steel with an improved impact toughness. Ni will also enhance the solubility of N, which will reduce the risk of nitride precipitation. However, the Ni content must be tuned with the other ferrite and austenite forming elements present in said duplex stainless steel, in order to achieve the desired duplex microstructure. The maximum content of Ni is therefore limited to 10.00 wt %. Hence, the content of Ni is from 6.00 to 10.00 wt %. According to one embodiment, the content of Ni is of from 6.50 to 9.50 wt %.

Nitrogen (N): 0.15 to 0.28 wt %

N is an austenite phase stabilizing alloying element and has a very strong interstitial solid solution strengthening effect. N thus contributes strongly to the strength of the present duplex stainless steel. N will also greatly improve the pitting corrosion resistance of the present stainless steel. However, a high content of N may reduce the hot workability at high temperatures and the toughness at room temperature. Further, if the N content is too high, chromium nitrides will form, which degrades the toughness and corrosion resistance even more. The N content is therefore from 0.15 to 0.28 wt %, such as from 0.17 to 0.25 wt %.

Phosphorus (P): Less than 0.04 wt %

P is an optional element and may be included. Normally, P is regarded as a harmful impurity and is present because the raw material used for the melt may contain P. It is desirable to have less than 0.04 wt % P.

Sulphur (S): Less than or Equal to 0.01 wt %

S is an optional element and may be considered as an impurity or may be included in order to improve the machinability. S may form grain boundary segregations and inclusions and will therefore restrict the high-temperature processability due to a reduced hot-ductility. Hence, the content of S should not exceed 0.01 wt %.

Copper (Cu) from 0.60 to 2.20 wt %

Cu is an austenite phase stabilizing alloying element. Cu will contribute to the yield strength but will have limited effects on the duplex stainless steel in low amounts. Furthermore, in the present duplex stainless steel Cu has a positive effect on the general corrosion resistance, especially in sulfuric acid solutions, when copper is 0.60 wt % or higher. However, too high amounts of Cu will affect the hot working properties negatively and reduce the solubility of N, thus the maximum content of Cu is 2.20 wt %. Hence, it has surprisingly been shown that if the content of Cu is from of 0.60 to 2.20 wt %, the obtained duplex stainless steel will have a higher yield strength than expected, which means that the material will be stronger, which is an advantage when used in for example in highly stressed sea water applications. According to one embodiment and in order to have the best properties, the Cu content is of from 1.10 to 1.90 wt %.

Aluminium (Al) Less than 0.05 wt %

Al is an optional element and may be used as a deoxidizing agent as it is effective in reducing the oxygen content during the steel production. However, a too high content of Al will increase the risk of precipitating AlN, which in turn will reduce the mechanical properties. Hence, the content of Al is less than 0.05 wt %, such as less than 0.03 wt %.

In the present duplex stainless steel, it has surprisingly been found that by balancing the content of the alloying elements Si, Mn, Cr, Ni, Mo, Cu, and N, the obtained duplex stainless steel will have a combination of desired properties and the desired content of ferrite phase.

Optionally small amounts of other alloying elements may be added to the duplex stainless steel as defined hereinabove or hereinafter in order to improve e.g. the processability, such as the hot ductility. Example of, but not limited to, such elements are Calcium (Ca), Magnesium (Mg), Boron (B), and Cerium (Ce). According to one embodiment, the amounts of one or more of these elements are of less than about 0.05 weight % in the duplex stainless steel as defined hereinabove or herein after.

The remainder of elements of the duplex stainless steel as defined hereinabove or hereinafter is Iron (Fe) and normally occurring impurities.

Examples of impurities are elements and compounds which have not been added on purpose but cannot be fully avoided as they normally occur as impurities in e.g. the raw material used for manufacturing of the duplex stainless steel.

When the terms "less than" or "less than or equal to" are used, the skilled person knows that the lower limit of the range is 0 wt % unless another number is specifically stated.

According to one embodiment, the present duplex stainless steel consists of all the alloying elements in the ranges as mentioned hereinabove or hereinafter.

According to one embodiment, the present duplex stainless steel has a Pitting Resistance Equivalent, also abbreviated as PRE, greater than or equal to 36 and wherein PRE=wt % Cr+3.3*wt % Mo. The PRE-value is a predictive measure of the pitting corrosion resistance of various types of stainless steels.

The present disclosure also relates to a component comprising a duplex stainless steel as defined hereinabove or hereinafter. The component could for example be selected from a forging, a bar, a rod, a plate, a wire, a sheet, a tube or a pipe. The component is for example hot worked and heat-treated.

The present disclosure also relates to a construction material comprising a duplex stainless steel as defined hereinabove or hereinafter. The construction material may for example be hot worked and heat-treated.

According to one embodiment, a component comprising the duplex stainless steel as defined hereinabove or hereinafter could be manufactured according to the following method:

A melt is provided. The melt could be obtained by for example melting scrap and/or raw material in a high frequency furnace. The melt is chemically analysed so that it contains the alloying elements according to the amounts of the present duplex stainless steel. The obtained melt is thereafter cast to an object, such as for example but not limited to an ingot, a slab, a billet or a bloom. The object could then optionally be heat treated. Examples but not limiting to heat treatment processes are solution heat treatment or homogenization. The object is thereafter hot worked to the desired component or pre-component. Examples of hot working processes are forging, hot rolling and extrusion. One or more hot working processes may be used in order to obtain the desired component or pre-component. The hot working is usually performed at temperatures between about 1000° C. to about 1300° C. The obtained component is then heat treated in order to achieve the desired microstructure and properties. The heat treatment is a solution heat treatment at a temperature between about 1000° C. to about 1100° C. After the solution heat treatment, the component is subsequently cooled by e.g. quenching in water or oil. The obtained component may then optionally be cold worked and/or heat treated. Examples of cold working processes are rolling, pilgering, drawing and straightening. Examples of heat treatment processes after cold working are annealing and ageing. More than one of these processes may optionally be used in the production of the final component.

The present disclosure is further described by the following non-limiting examples.

Examples

The different alloys and their corresponding alloy numbers are found in Table 1. The alloys falling within the scope of the present disclosure is marked with a "*". The alloys of Example 1 have been produced by melting in a high frequency furnace and were thereafter cast to ingots using 9" steel moulds. The weights of the ingots were approximately 270 kg. The ingots were then heat-treated at about 1050° C. for approximately 1 hour and then quenched in water followed by grinding of the ingot surface.

The ingots were thereafter heated to about 1250° C. and forged with a hammer to bars having a rectangular cross section of approximately 150×50 mm and subsequently quenched in water directly after forging. The obtained bars were solution heat-treated at 1050° C. for approximately 1 hour and then quenched in water. Material from these bars were used for manufacturing of samples for dilatometry testing, corrosion testing and mechanical testing.

Mechanical testing in the form of impact toughness testing on notched Charpy-V samples with the dimensions of 10×10×55 mm, was performed at a test temperature of −50° C. on all alloys. The results of the impact toughness tests are based on the average value of three Charpy-V samples of each alloy.

Tensile testing was performed according to the ASTM A-370 standard. The yield stress results, were based on the average value of three tensile tests specimens of each alloy.

The Critical Pitting Temperature corrosion testing, also abbreviated CPT, was performed according to the G48A method. Two samples were used for the tests at each testing temperature.

The structure stability was tested either by dilatometer heat treatments or isothermal furnace heat treatments.

All tests of Continuous Cooling Precipitates, also abbreviated CCP, were performed on cylindrical samples Ø3×10 mm, which were exposed to a temperature cycle in a dilatometer. The temperature cycles included a solution annealing at 1050° C. for 5 min followed by a linear cooling to room temperature, at cooling rates of 100° C./min, 30° C./min, 10° C./min, 2° C./min and 0.5° C./min. The amount of precipitated intermetallic phase in the microstructures were evaluated by light optical microscopy and in specific cases supplemented by Electron Back Scatter Diffraction, also abbreviated EBSD, for verification.

All tests of Temperature Time Precipitates, also abbreviated TTP, were performed on 20×20×20 mm samples, which had been solution heat treated at 1050° C. for 2 h and then quenched in water. The TTP samples were thereafter exposed to an isothermal heat treatment at a temperature of 900° C. for 3 h and then quenched in water. The amount of precipitated intermetallic phase in the microstructures were evaluated by X-Ray Diffraction analysis, also abbreviated XRD, supplemented by light optical microscopy and in specific cases also by EBSD for verification.

TABLE 1

Chemical composition in weight % (wt %), the balance for all alloys is Fe.

| Alloy | 1 | 2 | 3* | 4 | 5 | 6* | 7* | 8 | 9 | 10 | 11 | 12 | 13 |
|---|---|---|---|---|---|---|---|---|---|---|---|---|---|
| C | 0.009 | 0.010 | 0.009 | 0.011 | 0.010 | 0.007 | 0.007 | 0.011 | 0.007 | 0.008 | 0.007 | 0.009 | 0.010 |
| Si | 0.09 | 1.04 | 0.53 | 0.09 | 0.09 | 0.12 | 0.06 | 0.07 | 0.14 | 0.04 | 0.07 | 0.33 | 0.19 |
| Mn | 1.31 | 1.21 | 1.24 | 2.34 | 0.40 | 1.29 | 1.24 | 1.18 | 1.29 | 1.26 | 1.23 | 0.93 | 1.02 |
| P | 0.005 | 0.004 | 0.005 | 0.005 | 0.005 | 0.005 | 0.004 | 0.005 | 0.005 | 0.004 | 0.0004 | 0.005 | 0.007 |
| S | 0.0023 | 0.0014 | 0.0014 | 0.0006 | 0.0016 | 0.0030 | 0.0005 | 0.0015 | 0.0005 | 0.0025 | 0.0005 | 0.0039 | 0.0034 |

TABLE 1-continued

| Chemical composition in weight % (wt %), the balance for all alloys is Fe. | | | | | | | | | | | | | |
|---|---|---|---|---|---|---|---|---|---|---|---|---|---|
| Alloy | 1 | 2 | 3* | 4 | 5 | 6* | 7* | 8 | 9 | 10 | 11 | 12 | 13 |
| Cr | 30.17 | 30.42 | 30.55 | 30.44 | 30.35 | 31.48 | 30.40 | 30.51 | 28.59 | 32.39 | 34.31 | 24.65 | 31.72 |
| Ni | 6.77 | 9.40 | 8.15 | 6.78 | 6.96 | 8.10 | 7.69 | 5.93 | 6.16 | 7.89 | 11.06 | 7.08 | 7.47 |
| Mo | 1.25 | 1.79 | 1.56 | 1.29 | 1.27 | 1.73 | 1.64 | 1.00 | 1.92 | 0.77 | 0.56 | 3.82 | 3.39 |
| W | <0.02 | <0.02 | <0.02 | <0.02 | <0.02 | <0.02 | <0.02 | <0.02 | <0.02 | <0.02 | <0.02 | <0.02 | <0.02 |
| Co | <0.02 | <0.02 | <0.02 | <0.02 | <0.02 | <0.02 | <0.02 | <0.02 | <0.02 | <0.02 | <0.02 | <0.02 | <0.02 |
| V | <0.02 | <0.02 | <0.02 | <0.02 | <0.02 | <0.02 | <0.02 | <0.02 | <0.02 | <0.02 | <0.02 | <0.02 | <0.02 |
| Ti | <0.01 | <0.01 | <0.01 | <0.01 | <0.01 | <0.01 | <0.01 | <0.01 | <0.01 | <0.01 | <0.01 | <0.01 | <0.01 |
| Cu | 0.79 | 0.80 | 0.80 | 0.79 | 0.81 | 1.50 | 1.50 | 0.07 | 0.81 | 0.79 | 0.78 | 0.04 | 0.01 |
| Al | 0.003 | 0.034 | 0.018 | 0.012 | 0.009 | 0.005 | 0.028 | 0.003 | 0.020 | 0.003 | 0.013 | 0.006 | 0.012 |
| Sn | <0.02 | <0.02 | <0.02 | <0.02 | <0.02 | <0.02 | <0.02 | <0.02 | <0.02 | <0.02 | <0.02 | <0.02 | <0.02 |
| Nb | <0.02 | <0.02 | <0.02 | <0.02 | <0.02 | <0.02 | <0.02 | <0.02 | <0.02 | <0.02 | <0.02 | 0.06 | 0.02 |
| B | <0.003 | <0.003 | <0.003 | <0.003 | <0.003 | <0.003 | <0.003 | <0.003 | <0.003 | <0.003 | <0.003 | <0.003 | <0.003 |
| N | 0.28 | 0.16 | 0.22 | 0.27 | 0.28 | 0.19 | 0.18 | 0.39 | 0.25 | 0.28 | 0.23 | 0.30 | 0.48 |
| Ce | <0.05 | <0.05 | <0.05 | <0.05 | <0.05 | <0.05 | <0.05 | <0.05 | <0.05 | <0.05 | <0.05 | <0.05 | <0.05 |

TABLE 2

| The result of the testing | | | | | | | | | | | | | |
|---|---|---|---|---|---|---|---|---|---|---|---|---|---|
| Alloy | 1 | 2 | 3* | 4 | 5 | 6* | 7* | 8 | 9 | 10 | 11 | 12 | 13 |
| Rp0.2 [MPa] | 599 | 606 | 624 | 602 | 595 | 626 | 618 | 598 | 597 | 586 | 617 | 557 | 680 |
| Charpy-V −50° C. [J] | 141 | 94 | 227 | 101 | 113 | 146 | 182 | 35 | 123 | 121 | 189 | 69 | 18 |
| CPT [° C.] | 40 | 55 | 50 | 35 | 30 | 65 | 50 | 30 | 40 | 30 | 35 | 65 | 65 |
| PRE | 34 | 36 | 36 | 35 | 35 | 37 | 36 | 34 | 35 | 35 | 36 | 37 | 43 |
| Intermetallics TTP [vol. %] | 1 | 48 | 17 | 3 | 1 | 24 | 5 | 3 | 3 | 4 | 1 | 26 | 43 |
| Intermetallics CCP [° C./min] | 10 | 100 | 10 | 10 | 0.5 | 30 | 10 | 0.5 | 2 | 10 | 30 | 30 | 100 |

As can be seen from Table 2 above, the present inventive alloys, marked with a "*", have a combination of the desired properties, necessary to fulfill the requirements for the present use and application of the duplex stainless steel. In these alloys, the amount of detrimental intermetallic phases, i.e. sigma phase, will be low as shown by the TTP and CCP values. Further, the mechanical properties will be high, such as strength, as the yield strength, Rp0.2, is greater than 610 MPa, and the impact toughness, Charpy-V, is greater than 130 J at −50° C. Additionally, the corrosion resistance is good, as these alloys both have PRE greater than or equal to 36 and CPT greater than or equal to 50° C.

In order to prevent detrimental amounts of intermetallic phases, certain requirements should be met regarding the precipitation of such phases during isothermal heating conditions or continuous cooling conditions.

"Intermetallics TTP" shows the vol. % of intermetallic phases, the values display the vol % of intermetallic phases formed during isothermal heating at a temperature of 900° C. for 3 h. The critical amount of intermetallic phases is preferably lower than 25 vol. % under these conditions, whereby the material requirements are achieved for the desired application of this material.

"Intermetallics CCP" shows the critical cooling rates. Lower values indicate an increased structural stability. The critical cooling rate is defined as the linear cooling rate, which gives less than 3 vol. % intermetallic phase. A CCP value lower than or equal to 30° C./min is preferred in order to achieve the material requirements for the desired application of this material.

As shown by the tables above, the inventive duplex stainless steel has a combination of all the desired properties.

The invention claimed is:

1. A duplex stainless steel comprising in weight % (wt %):

| | |
|---|---|
| C | less than 0.03; |
| Si | less than 0.60; |
| Mn | 0.40 to 2.00; |
| P | less than 0.04; |
| S | less than or equal to 0.01; |
| Cr | more than 30.00 to 33.00; |
| Ni | 6.00 to 10.00; |
| Mo | 1.30 to 2.90; |
| N | 0.15 to 0.28; |
| Cu | 0.60 to 2.20; |
| Al | less than 0.05; |
| balance Fe and unavoidable impurities, | |

wherein said duplex stainless steel has a ferrite content of from 40 to 70 vol % and a balance is austenite, wherein said duplex stainless steel has a CPT of greater than or equal to 50° C. and equal to or less than 65° C., where CPT is determined according to the G48A method, and wherein said duplex stainless steel has a yield strength Rp0.2 of greater than 610 MPa determined by ASTM A-370.

2. The duplex stainless steel according to claim 1, wherein said duplex stainless steel has a PRE, which is greater than or equal to 36 and wherein PRE=wt % Cr+3.3*wt % Mo.

3. The duplex stainless steel according to claim 1, wherein the content of Al is less than 0.03 wt %.

4. The duplex stainless steel according to claim 1, wherein the content of Si is less than 0.30 wt %.

5. The duplex stainless steel according to claim 1, wherein the content of Mn is 0.60-1.80 wt %.

6. The duplex stainless steel according to claim 1, wherein the content of Ni is 6.50-9.50 wt %.

7. The duplex stainless steel according to claim 1, wherein the content of Cu is 1.10-1.90 wt %.

8. The duplex stainless steel according to claim 1, wherein the content of N is 0.17-0.25 wt %.

9. The duplex stainless steel according to claim 1, wherein the content of Cr is 30.50-32.50 wt %.

10. The duplex stainless steel according to claim 1, wherein the content of Mo is 1.35-2.90 wt %.

11. A method for manufacturing a component comprising a duplex stainless steel according to claim 1, the method comprising the following steps:

providing a melt comprising an alloy composition, including in weight % (wt %):

| | |
|---|---|
| C | less than 0.03, |
| Si | less than 0.60, |
| Mn | 0.40 to 2.00, |
| P | less than 0.04, |
| S | less than or equal to 0.01, |
| Cr | more than 30.00 to 33.00, |
| Ni | 6.00 to 10.00, |
| Mo | 1.30 to 2.90, |
| N | 0.15 to 0.28, |
| Cu | 0.60 to 2.20, |
| Al | less than 0.05, |
| balance Fe and unavoidable impurities; | |

casting the melt to an object;

optionally heat-treating the object;

hot working the object to a component;

heat-treating the component;

optionally cold working the component; and optionally heat-treating the component;

wherein the heat treatment between the hot working and the optional cold working is a solution heat treatment.

12. A component comprising a duplex stainless steel according to claim 1.

13. The component according to claim 12, wherein the component is a forging, a bar, a rod, a plate, a wire, a sheet, a tube or a pipe.

14. A construction material comprising a duplex stainless steel according to claim 1.

15. The duplex stainless steel according to claim 1, wherein the content of Mo is 1.40-2.80 wt %.

16. The duplex stainless steel according to claim 1, wherein said duplex stainless steel has a value for PRE of greater than or equal to 36 and equal to or less than 37, where PRE=wt % Cr+3.3*wt % Mo.

17. The duplex stainless steel according to claim 1, wherein said duplex stainless steel has a vol. % of intermetallic phases of equal to or less than 25 vol. %, where the vol. % of intermetallic phases are determined during isothermal heating at a temperature of 900° C. for 3 hours.

18. The duplex stainless steel according to claim 1, wherein said duplex stainless steel has an impact toughness equal to or greater than 130 J, where the impact toughness is determined on notched Charpy-V samples with dimensions of 10×10×55 mm at a test temperature of −50° C.

19. The duplex stainless steel according to claim 1, wherein said duplex stainless steel has a value for PRE of greater than or equal to 36 and equal to or less than 37, where PRE=wt % Cr+3.3*wt % Mo, wherein said duplex stainless steel has a vol. % of intermetallic phases of equal to or less than 25 vol. %, where the vol. % of intermetallic phases are determined during isothermal heating at a temperature of 900° C. for 3 hours, and wherein said duplex stainless steel has an impact toughness equal to or greater than 130 J, where the impact toughness is determined on notched Charpy-V samples with dimensions of 10×10×55 mm at a test temperature of −50° C.

20. The duplex stainless steel according to claim 19, wherein the vol. % of intermetallic phases is equal to or greater than 5 and equal to or less than 24 vol. %, wherein the yield strength Rp0.2 is greater than 618 MPa and equal to or less than 624 MPa, and wherein the impact toughness is equal to or greater than 146 J and equal to or less than 227 J.

21. A duplex stainless steel comprising in weight % (wt %):

| | |
|---|---|
| C | less than 0.03; |
| Si | less than 0.60; |
| Mn | 0.60 to 1.80; |
| P | less than 0.04; |
| S | less than or equal to 0.01; |
| Cr | more than 30.00 to 32.50; |
| Ni | 6.50 to 9.50; |
| Mo | 1.40 to 2.80; |
| N | 0.17 to 0.25; |
| Cu | 0.60 to 1.90; |
| Al | less than 0.03; |
| balance Fe and unavoidable impurities, | |

wherein said duplex stainless steel has a ferrite content of from 40 to 70 vol % and a balance is austenite, wherein said duplex stainless steel has a CPT of greater than or equal to 50° C. and equal to or less than 65° C., where CPT is determined according to the G48A method, and wherein said duplex stainless steel has a yield strength Rp0.2 of greater than 610 MPa determined by ASTM A-370.

22. The duplex stainless steel according to claim 21, wherein said duplex stainless steel has a value for PRE of greater than or equal to 36 and equal to or less than 37, where PRE=wt % Cr+3.3*wt % Mo.

23. The duplex stainless steel according to claim 21, wherein said duplex stainless steel has a vol. % of intermetallic phases of equal to or less than 25 vol. %, where the vol. % of intermetallic phases are determined during isothermal heating at a temperature of 900° C. for 3 hours.

24. The duplex stainless steel according to claim 21, wherein said duplex stainless steel has an impact toughness equal to or greater than 130 J, where the impact toughness is determined on notched Charpy-V samples with dimensions of 10×10×55 mm at a test temperature of −50° C.

25. The duplex stainless steel according to claim 21, wherein said duplex stainless steel has a value for PRE of greater than or equal to 36 and equal to or less than 37, where PRE=wt % Cr+3.3*wt % Mo, wherein said duplex stainless steel has a vol. % of intermetallic phases of equal to or less than 25 vol. %, where the vol. % of intermetallic phases are determined during isothermal heating at a temperature of 900° C. for 3 hours, and wherein said duplex stainless steel has an impact toughness equal to or greater than 130 J, where the impact toughness is determined on notched Charpy-V samples with dimensions of 10×10×55 mm at a test temperature of −50° C.

26. The duplex stainless steel according to claim 25, wherein the vol. % of intermetallic phases is equal to or greater than 5 and equal to or less than 24 vol. %, wherein the yield strength Rp0.2 is greater than 618 MPa and equal to or less than 624 MPa, and wherein the impact toughness is equal to or greater than 146 J and equal to or less than 227 J.

* * * * *